US009746165B2

(12) United States Patent
Ritter et al.

(10) Patent No.: US 9,746,165 B2
(45) Date of Patent: Aug. 29, 2017

(54) WEARABLE ILLUMINATION GEAR

(76) Inventors: Thomas Ritter, Brooklyn, NY (US); Christopher Ritter, Bangor, ME (US)

( * ) Notice: Subject to any disclaimer, the term of this patent is extended or adjusted under 35 U.S.C. 154(b) by 42 days.

(21) Appl. No.: 12/856,222

(22) Filed: Aug. 13, 2010

(65) Prior Publication Data

US 2011/0038142 A1 Feb. 17, 2011

Related U.S. Application Data

(60) Provisional application No. 61/233,584, filed on Aug. 13, 2009, provisional application No. 61/300,504, filed on Feb. 2, 2010.

(51) Int. Cl.

| | |
|---|---|
| ***F21V 21/14*** | (2006.01) |
| *F21V 33/00* | (2006.01) |
| *F21W 111/10* | (2006.01) |
| *F21Y 115/10* | (2016.01) |

(52) U.S. Cl.

CPC ..... *F21V 21/145* (2013.01); *F21V 33/0008* (2013.01); *F21W 2111/10* (2013.01); *F21Y 2115/10* (2016.08)

(58) Field of Classification Search

CPC .... A41D 13/01; A41D 27/085; A43B 1/0036; F21Y 2101/02; F21L 11/00

USPC ..... 362/108

See application file for complete search history.

(56) References Cited

U.S. PATENT DOCUMENTS

| | | | | |
|---|---|---|---|---|
| 1,825,088 | A | 9/1931 | Powell et al. | |
| 2,555,871 | A | 6/1951 | Caggiano | |
| 2,845,155 | A * | 7/1958 | Sneyd-Kynnersley | 190/18 A |
| 3,154,787 | A * | 11/1964 | Newman | 2/460 |
| 4,328,533 | A | 5/1982 | Paredes | |
| 4,924,362 | A | 5/1990 | Janko et al. | |
| 5,070,436 | A * | 12/1991 | Alexander et al. | 362/108 |
| 5,128,843 | A | 7/1992 | Guritz | |
| 5,434,759 | A * | 7/1995 | Endo et al. | 362/108 |
| 5,630,382 | A | 5/1997 | Barbera et al. | |
| 5,690,413 | A * | 11/1997 | Coughlin | 362/108 |
| 6,095,657 | A * | 8/2000 | Kent | F21L 11/00 362/108 |
| 6,106,130 | A | 8/2000 | Harding | |
| 6,109,761 | A | 8/2000 | Smith et al. | |
| 6,185,738 | B1 * | 2/2001 | Sidebottom | 2/2.5 |
| 6,283,622 | B1 | 9/2001 | Chupp et al. | |
| 6,315,426 | B1 | 11/2001 | Buller, Jr. | |
| 6,547,456 | B2 | 4/2003 | Wechsler et al. | |

(Continued)

FOREIGN PATENT DOCUMENTS

| | | |
|---|---|---|
| CA | 2265142 A1 | 9/2000 |
| GB | 2132463 A1 | 7/1984 |

*Primary Examiner* — Alan Cariaso
*Assistant Examiner* — Mark Tsidulko
(74) *Attorney, Agent, or Firm* — Jeffrey Joyce; Patricia Mathers

(57) ABSTRACT

The invention is illumination gear that has a strap pad slidably mounted on a strap. A battery-operated lamp is mounted on the strap pad. The strap pad with lamp may be adjusted anywhere along the strap, so as to adjust the position of the lamp to a desired height. The illumination gear may be constructed as a harness, as a vest, or as a set of suspenders. Anchor straps may be provided on the vest or the harness, to secure the straps to belt loops on a trouser waistband or to another garment, to prevent the illumination gear from riding up or shifting position.

8 Claims, 12 Drawing Sheets

(56) References Cited

U.S. PATENT DOCUMENTS

| | | | | |
|---|---|---|---|---|
| 6,561,845 | B2 | 5/2003 | Ocheltree et al. | |
| 6,991,343 | B2 | 1/2006 | Langley et al. | |
| 7,175,295 | B2 | 2/2007 | Bretz et al. | |
| 7,185,997 | B2 | 3/2007 | Simoni | |
| 7,281,813 | B2 | 10/2007 | Golle et al. | |
| 7,922,349 | B2 * | 4/2011 | Hunnewell | 362/157 |
| 2003/0161139 | A1 * | 8/2003 | Putallaz | 362/108 |
| 2007/0105404 | A1 | 5/2007 | Lee et al. | |
| 2008/0185785 | A1 | 8/2008 | Sullivan | |

* cited by examiner

WEARABLE ILLUMINATION GEAR

BACKGROUND INFORMATION

Field of the Invention

The invention relates to the field of illumination devices that are worn on a person's body.

Discussion of the Prior Art

Many occupations and types of work require that a person hold or carry a portable source of light, such as a flashlight, while at the same time using one's hands to perform some task. It is often inconvenient or impossible to do this and, for this reason, headbands with lights mounted on them are often used.

It can be cumbersome to carry a lamp on one's head. The lamp can get in the way when working in cramped spaces and it can cause fatigue and stress on the neck and shoulders. It is also often the case with headband-supported lamps, that it is difficult to focus the light on precisely the area where the person's hands typically are, in the area directly in the front of the person's waist or upper torso.

Typically, a person working on a task has his or her hands in front of the upper torso, that being the most comfortable position for the arms and hands. Ideally, the source of light would be close to where the hands are.

What is needed, therefore, is a convenient means of providing a source of light that can be readily adjusted to illuminate the area in front of a person's upper torso.

BRIEF SUMMARY OF THE INVENTION

The object of the invention is achieved by providing illumination gear that provides a source of light that is carried on the torso of a person and that is adjustable in position along a distance between the waist and the shoulder of the person.

The illumination gear according to the invention may be a shoulder harness, a pair of suspenders, or a vest. In each case, the gear according to the invention provides a strap pad that is slidably assembled on a strap, the strap extending from the shoulder area downward toward the waist on the front of the illumination gear. An illumination means, i.e., a lamp, is mounted on the strap pad. The particular configuration of the strap and strap pad allow the strap pad to be slidably adjustable in position along the strap. The user is able to very easily and intuitively adjust the vertical position of the lamp, using only one hand. For example, the lamp may be positioned chest high to provide maximum illumination at that height, or be positioned at the shoulder.

The illumination gear may include anchor straps with fastener devices at the ends, to allow the user to anchor the gear to another garment, for example, to belt loops on the waistband of a pair of trousers. This is to prevent the illumination gear from shifting, riding up, twisting, etc.

The illumination means is a commercially available battery operated lamp that is mounted on a base, such that the direction of illumination may also be adjusted.

BRIEF DESCRIPTION OF THE DRAWINGS

The present invention is described with reference to the accompanying photographs. In the drawings, like reference numbers indicate identical or functionally similar elements. The drawings are not drawn to scale.

DETAILED DESCRIPTION OF THE INVENTION

Figure 1:
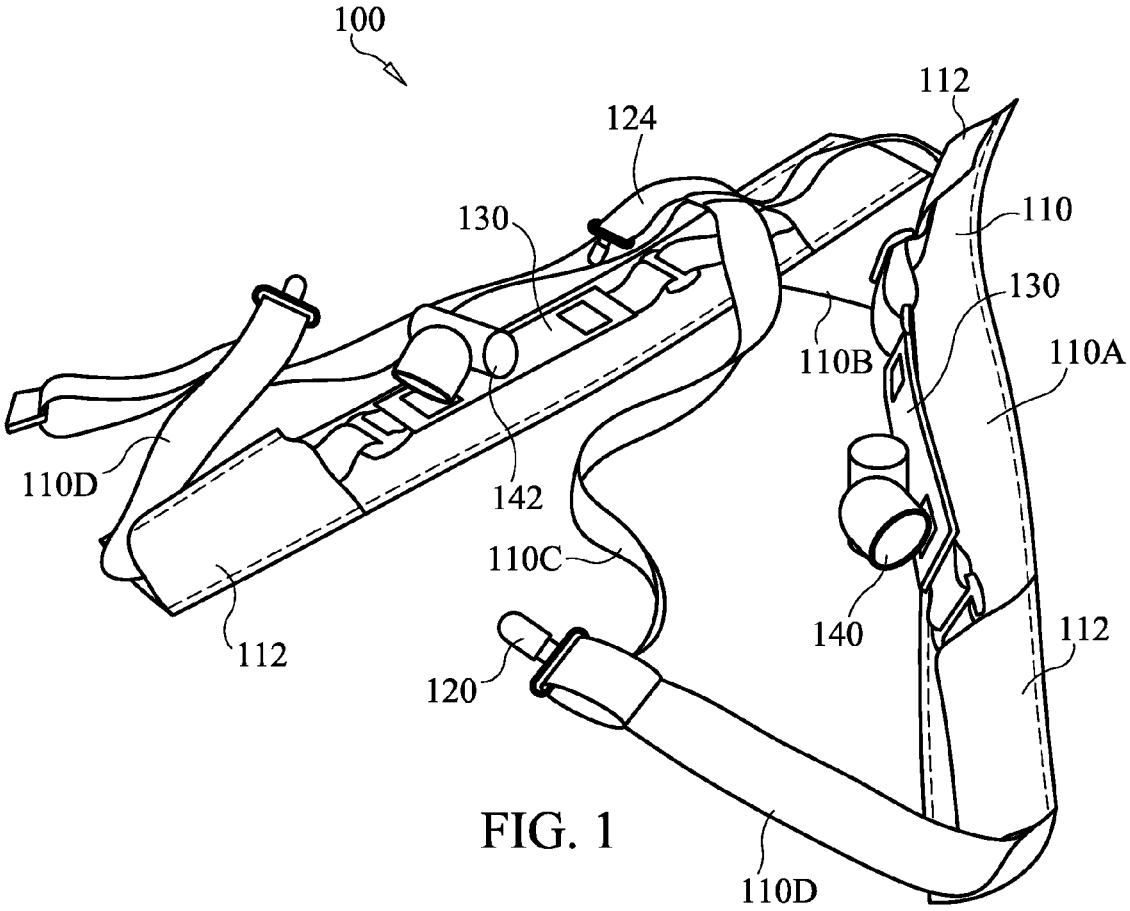
FIG. 1 illustrates a first embodiment of the illumination gear according to the invention.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-5 illustrate a first embodiment of illumination gear 100 according to the invention, which comprises a harness 110 and an illumination device 140 that is adjustably assembled on the harness 110. The harness 110 includes a pair of padded straps 110A through which suspender-like adjustable straps 110D extend. The two padded straps 110A are connected on the back by a strap connector 110B, which serves to keep the padded straps 110A in proper alignment and for reasons of comfort. A cross-strap 110C couples the adjustable straps 100D front and back, so as to hold the illumination gear 100 in place on the upper torso of a person. Anchor devices 120 are provided on the adjustable straps 110D to anchor the harness 110 to a waistband of trousers or other garment worn by the person. For example, ends of the front portion of the padded straps 110A may be fitted with snap clips that are attachable to the waistband of the trousers or other garment. These front anchor devices 122 may also be placed at any practical location on the cross strap 110B, as well as on the adjustable straps 110D. A back anchor device 124 may also be attached to the cross-strap 110C on the rear side of the harness 110.

The illumination device or lamp 140 is mounted on each of the padded straps 110A. The lamp 140 is ideally a battery-operated, LED illumination device 142. A very suitable lamp is one that is mounted on a base 144 that allows the user to vary the direction of the light beam. Examples of suitable lamps are the STREAMLIGHT ARGO HP and the STREAMLIGHT Enduro headlamps, made by Streamlight of Eagleville, Pa. One advantage of these headlamps is that they are adjustable in orientation, the lamp having a pivot axis about which the body of the lamp can rotate relative to a base 144. The base 144 is securely attached to a strap pad 130 by conventional fastening means 146A, such as rivets, threaded fasteners, posts with quick-lock ends, etc. The strap pad 130 is a conventional shoulder pad that is typically used with luggage straps, to prevent the heavy load of the luggage from digging into the shoulder. See also FIG. 16 for details of the lamp 140 mounted on the strap pad 130.

Figure 2:
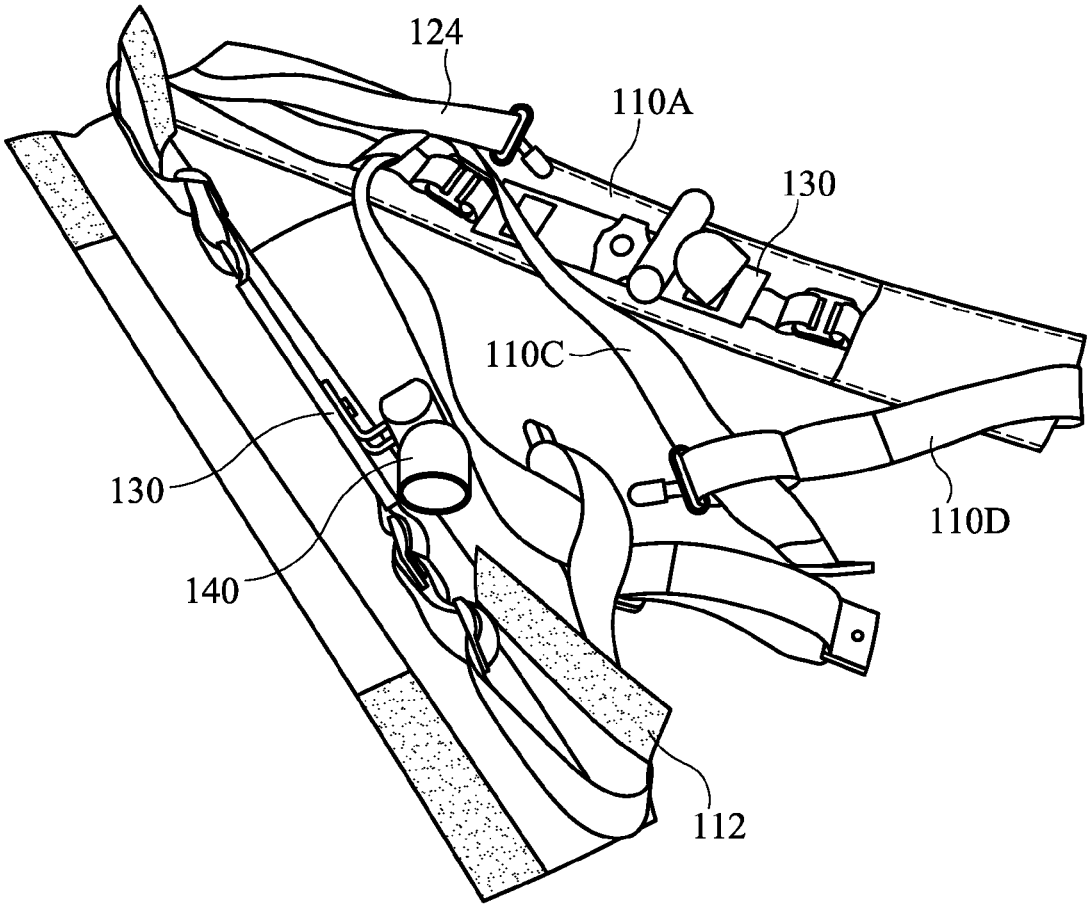
FIG. 2 illustrates the illumination gear of FIG. 1, showing the strap guide pocket opened up.
Figure 3:
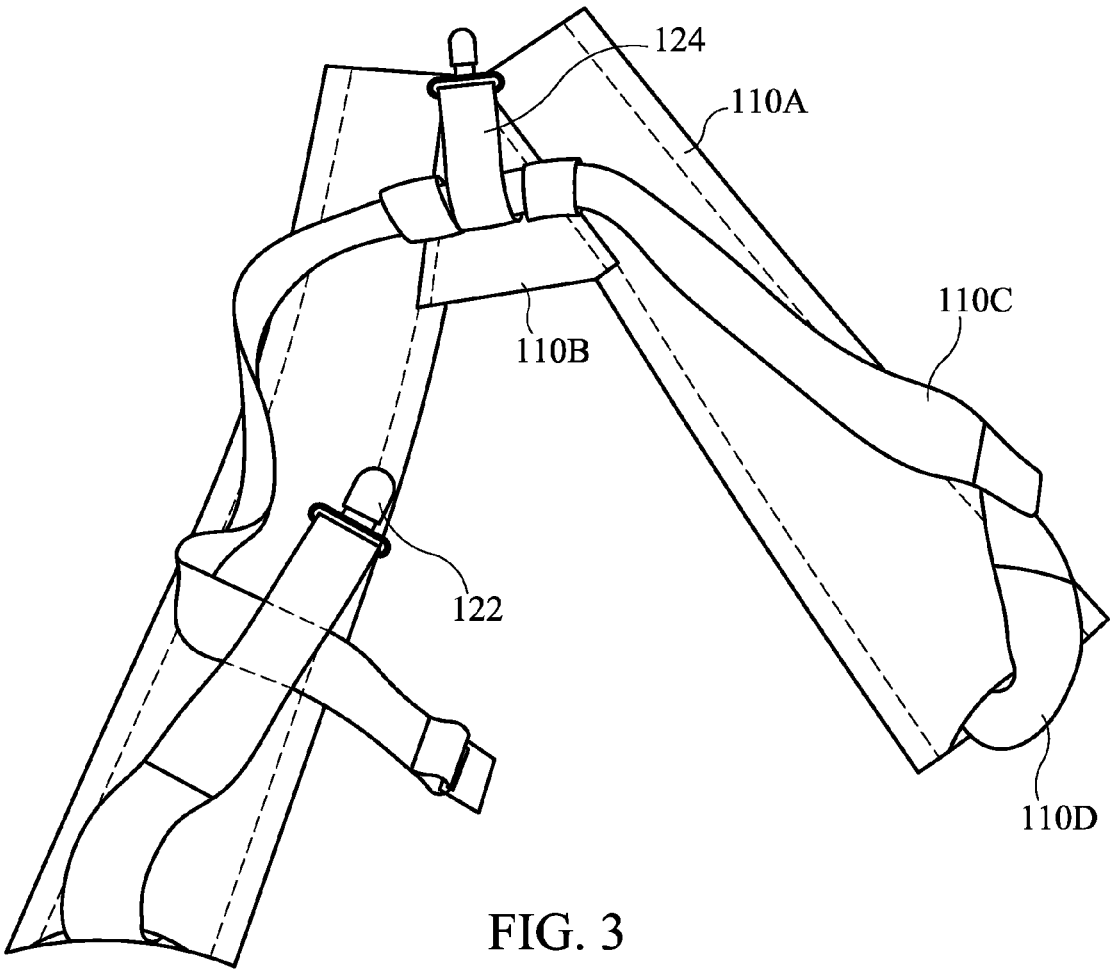
FIG. 3 shows the inside of the illumination gear of FIG. 1.
Figure 4:
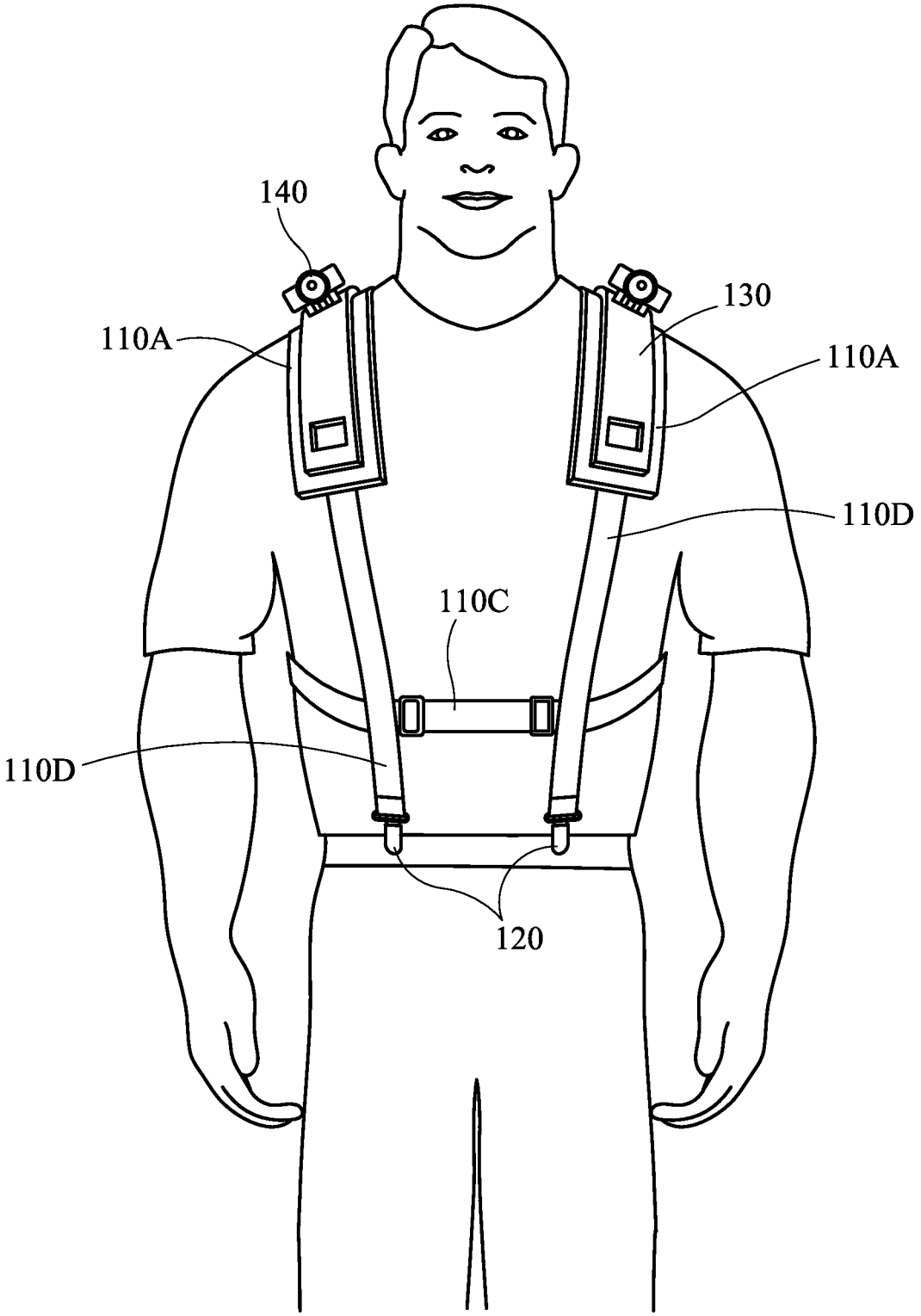
FIG. 4 shows a front view of the illumination gear of FIG. 1 as worn by a person.
Figure 5:
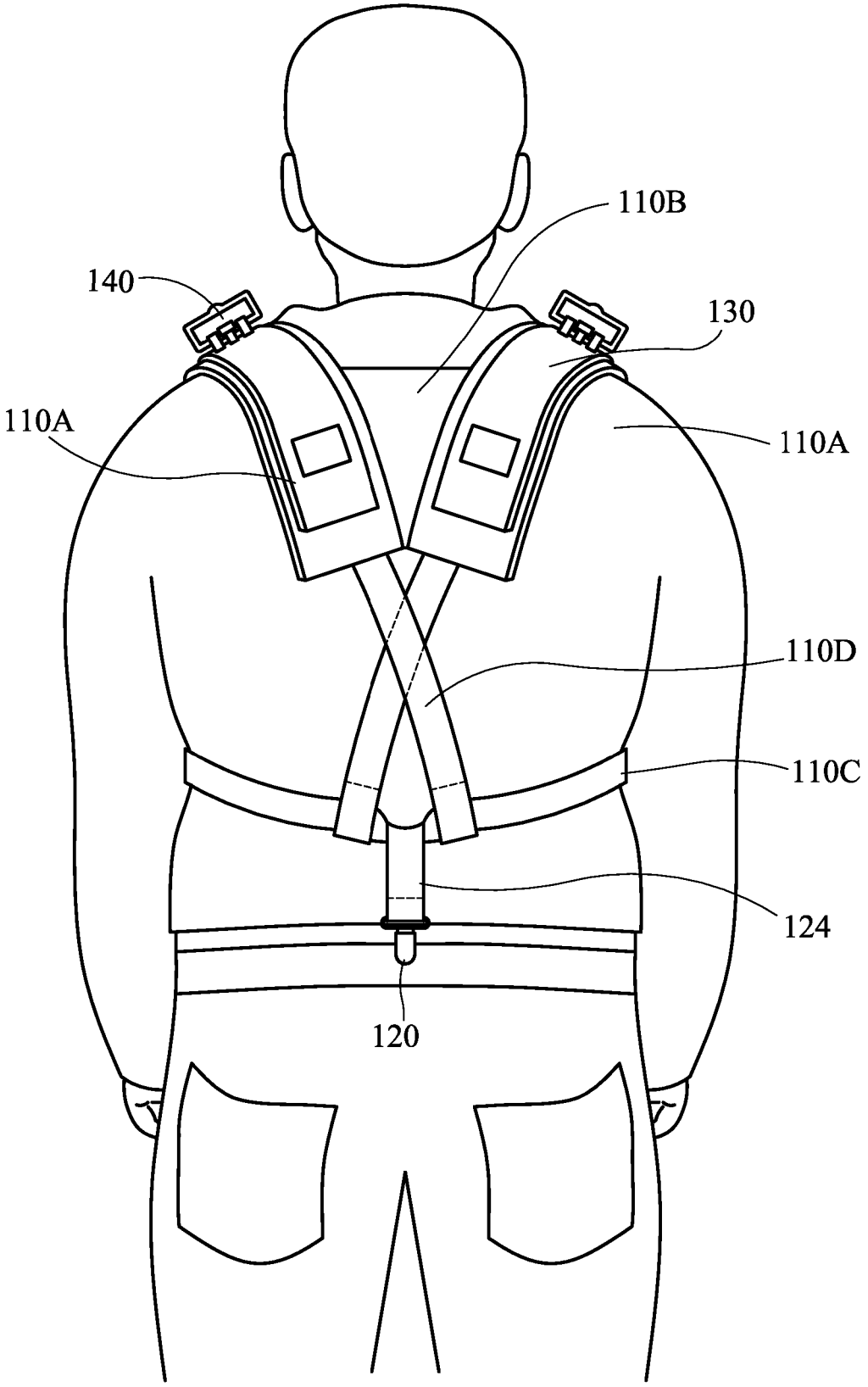
FIG. 5 shows a rear view of the illumination gear of FIG. 1 as worn by a person.

It was a surprising discovery of the inventors to realize that the strap pad 130 served well as an adjustable carrier for the lamp 140. In FIGS. 2 and 4, the lamp 140 is shown placed at shoulder level. Depending on the particular intended use of the illumination gear 100, however, it may be desirable to position the lamp 140 lower down on the padded straps 110A. Use of the strap pad 130 provides easy adjustability of the lamp 140. The adjustable strap 110D is threaded through openings in the strap pad 130. The stiffness of the strap pad 130 tends to grip the strap portion that is threaded through the openings in a secure manner, so that the pad 130 does not slip down on the strap 110D, even with the weight of the lamp 140 on it. The friction of the strap pad 130 on the strap 110D, abetted by the rounded slope of the shoulder, provides stability of the pad 130 and lamp 140 at any vertical position. The vertical position of the lamp 140 may be easily and intuitively adjusted by the user, with one hand, simply by pushing the strap pad 130 to the desired position along the exposed portion of the adjustable strap 110D.

The adjustable strap 110D is guided along the upper surface of the padded strap, as best seen in FIGS. 1 and 2. A strap guide pocket 112 is provided on each end of the padded strap 110A, in order to keep the adjustable strap 110D in proper position on the padded strap.

Figure 6:
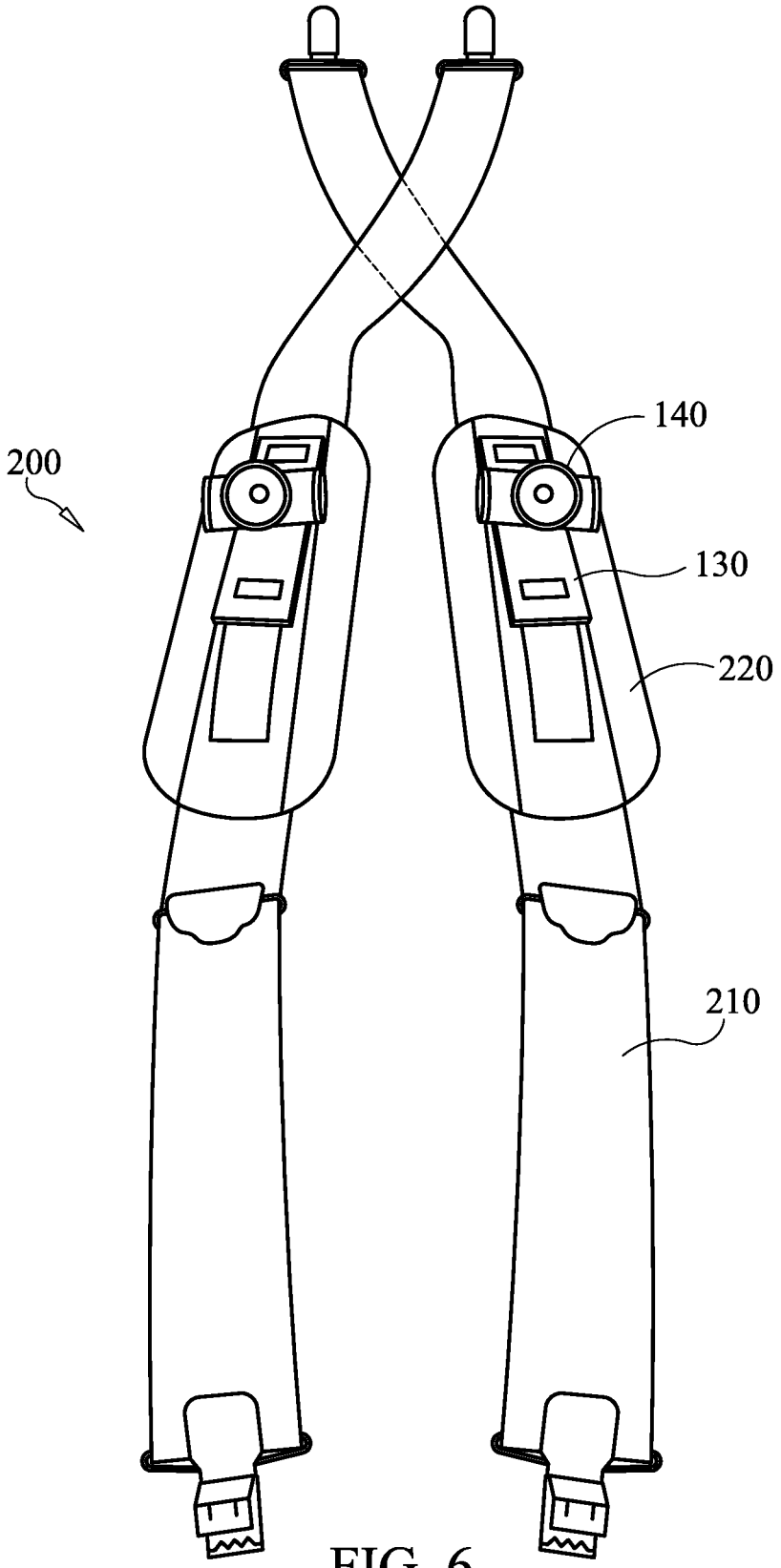
FIG. 6 illustrates a second embodiment of a illumination gear according to the invention.
Figure 7:
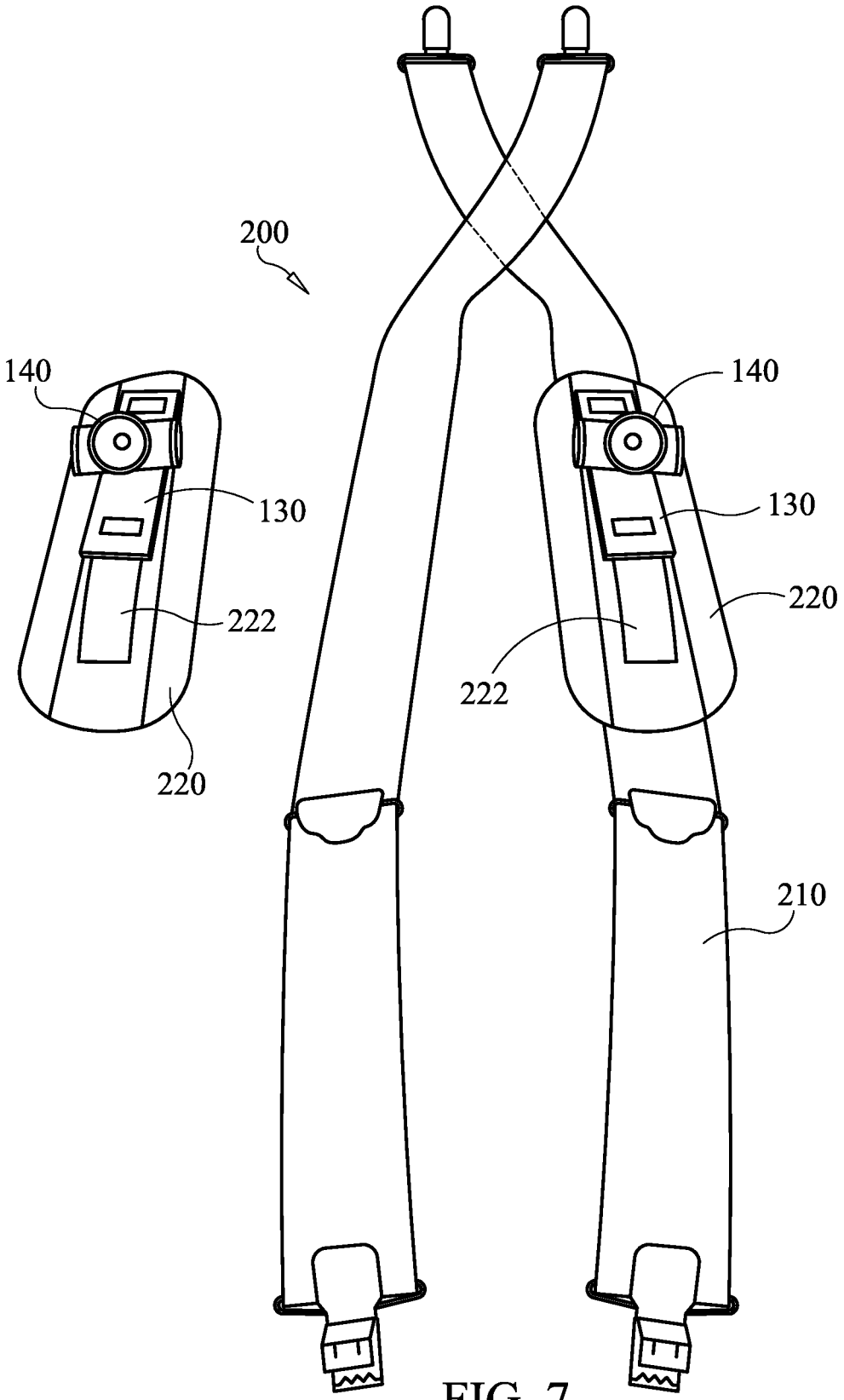
FIG. 7 illustrates a removable strap pad.
Figure 8:
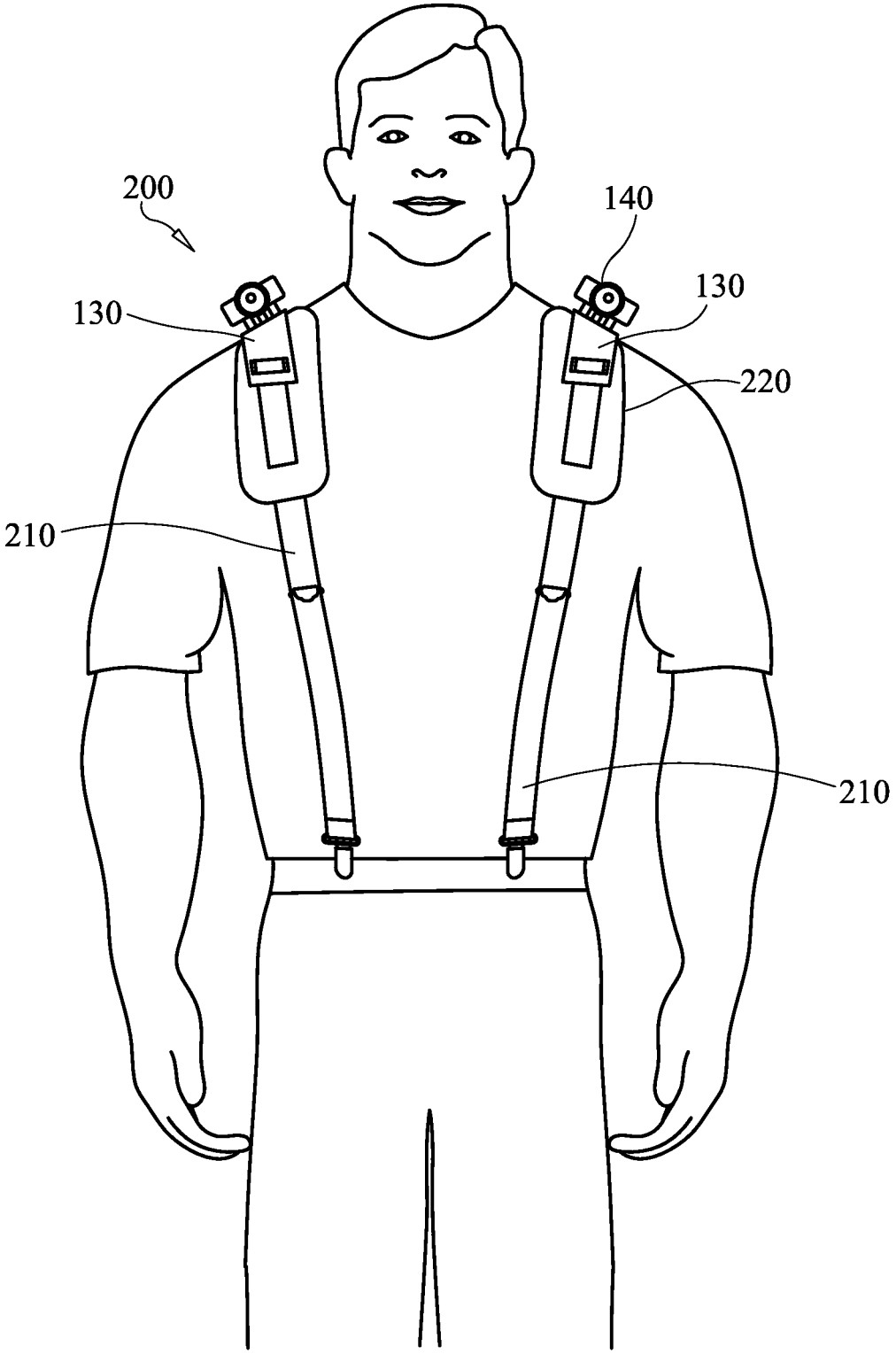
FIG. 8 shows front view of the illumination gear of FIG. 6 as worn by a person.

FIGS. 6-8 illustrate a second embodiment of illumination gear 200 according to the invention. In this embodiment, the illumination gear 200 comprises a conventional set of suspenders 210 on which a padded shoulder strap 220 is removably mounted. A strap pad 130, similar to the strap pad 130 described above, is slidably assembled on a strap 222 that is provided on the shoulder strap 220. The illumination means or lamp 140 is mounted on one or both of the shoulder straps 220.

Figure 9:
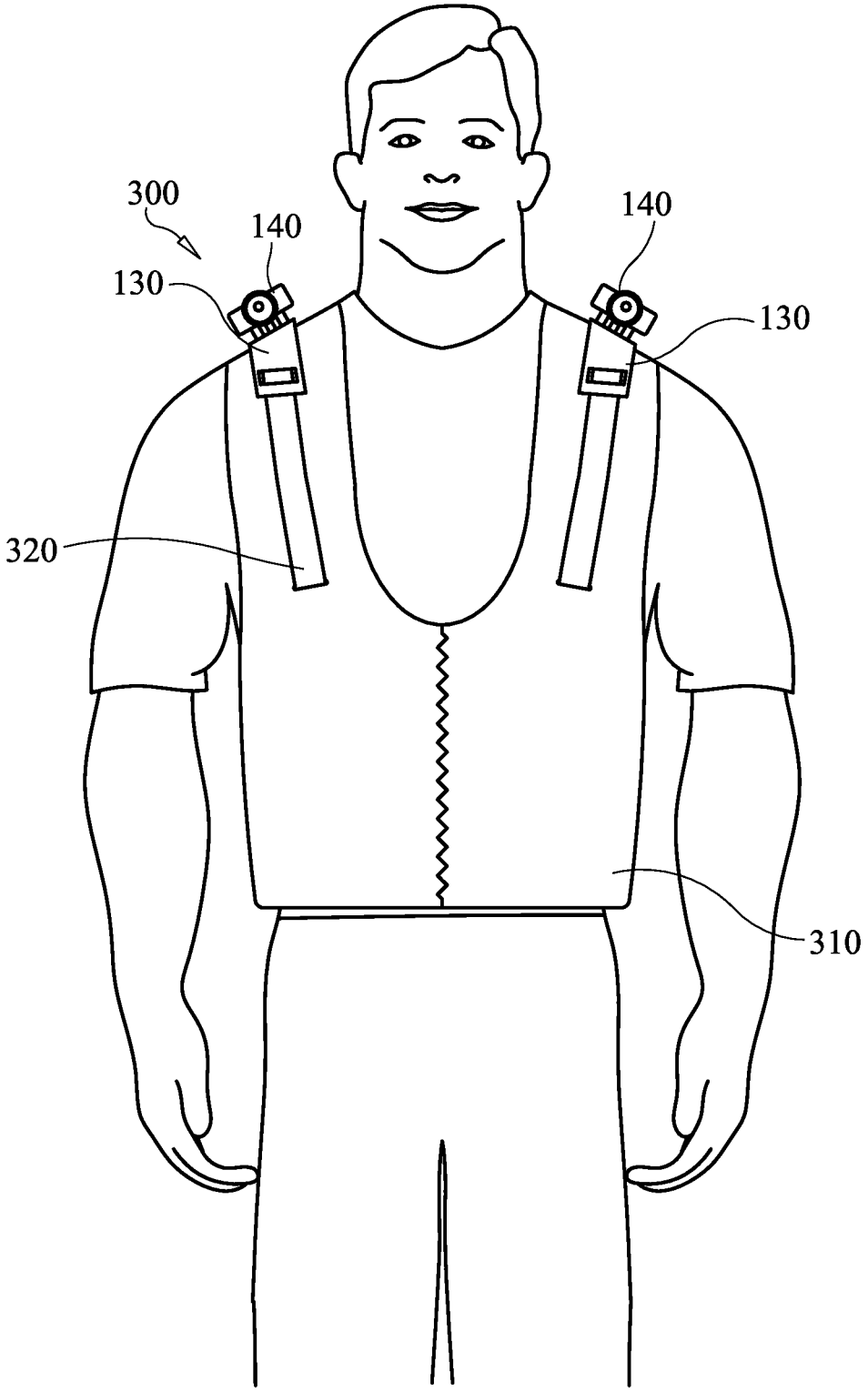
FIG. 9 illustrates a third embodiment of the illumination gear according to the invention, which is a vest.
Figure 10:
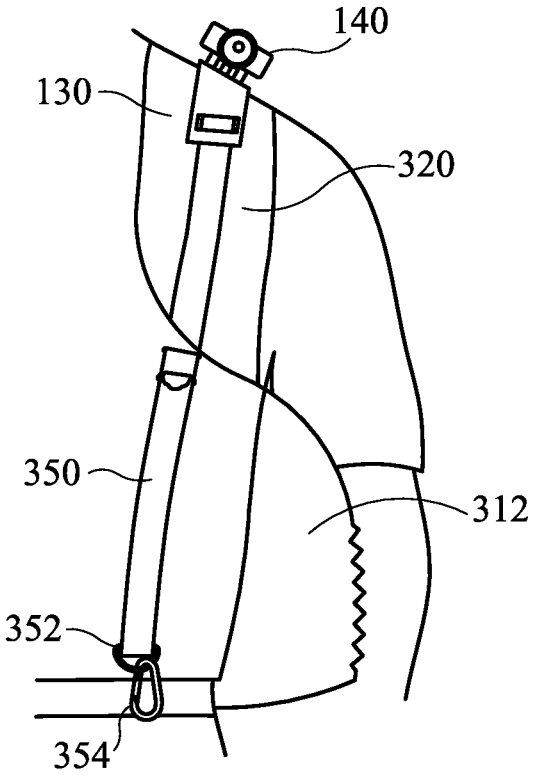
FIG. 10 shows the vest with a front anchor strap anchored to a belt loop.
Figure 11:
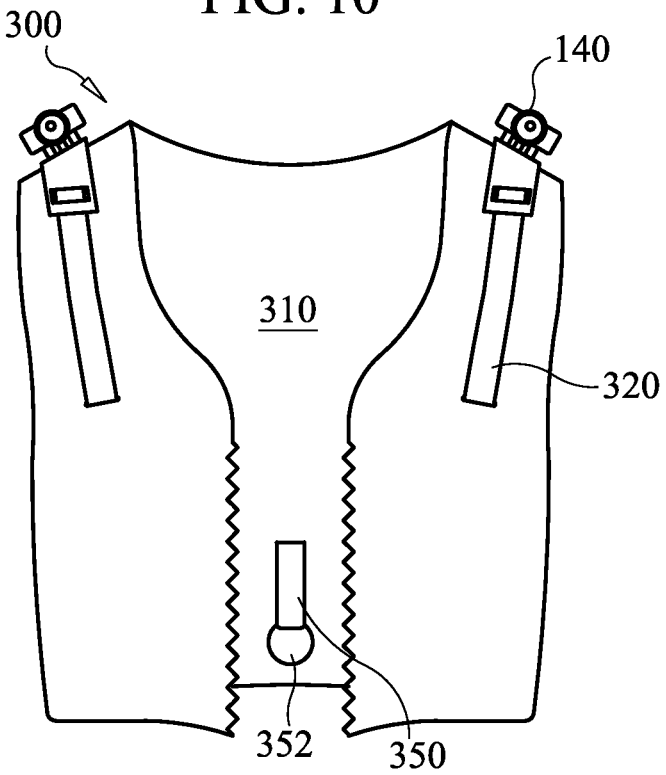
FIG. 11 shows a back anchor strap on the inside of the vest back.

FIGS. 9-11 illustrate a third embodiment of illumination gear 300 according to the invention. Illumination gear 300 is constructed of a conventional garment, such as a safety vest 310, which is outfitted with an illumination means 340, which comprises a strap-pad mounting strap 320. The strap pad 130 and the lamp 140 previously described are slidably mounted on the strap-pad mounting strap 320. Anchor straps 350, although not required, may also be provided on the illumination gear 300. FIG. 9 shows the illumination gear 300 worn by a person. The lamps 140 are placed at shoulder level, although it is understood that one or both of them may be positioned lower on the strap-pad mounting strap 320. FIG. 10 is a partial front view of the illumination gear 300, showing a front half 312 folded aside to expose an anchor strap 350 that is fastened to a belt loop on the person's trousers. In the embodiment shown, the anchor strap 350 is equipped with a D-ring 352, which is fastened to the belt loop by means of a carabiner 354. FIG. 11 illustrates an anchor strap 350 with D-ring 352, that may be affixed to the back of the vest 310, for anchoring the back to a belt loop. It is understood, that all manner of conventional fastening means may be used for anchoring the anchor straps 350 to a belt or other garment and that the combination of D-ring and carabiner is provided for purposes of illustration only. Snap clips, for example, may be quite suitable for anchoring the illumination gear to trousers or another garment.

Figure 12:
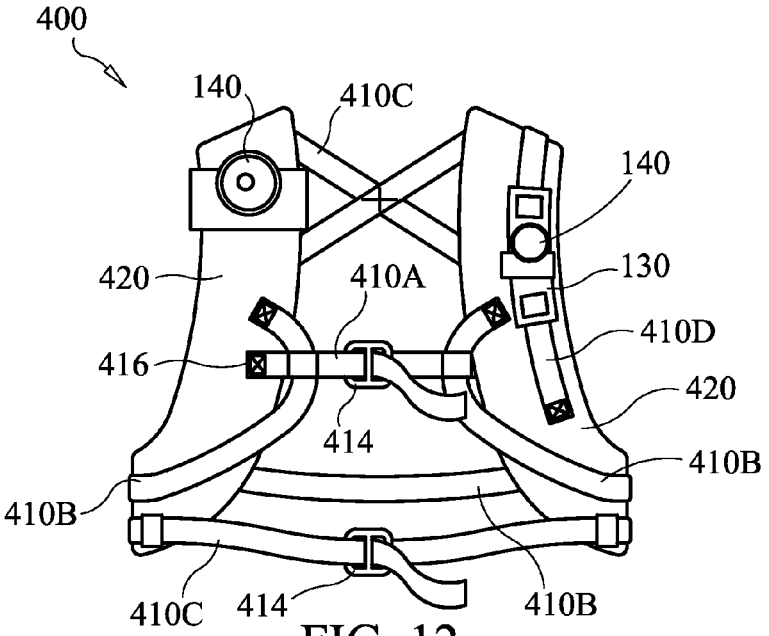
FIG. 12 illustrates a fourth embodiment of the illumination gear according to the invention.
Figure 13:
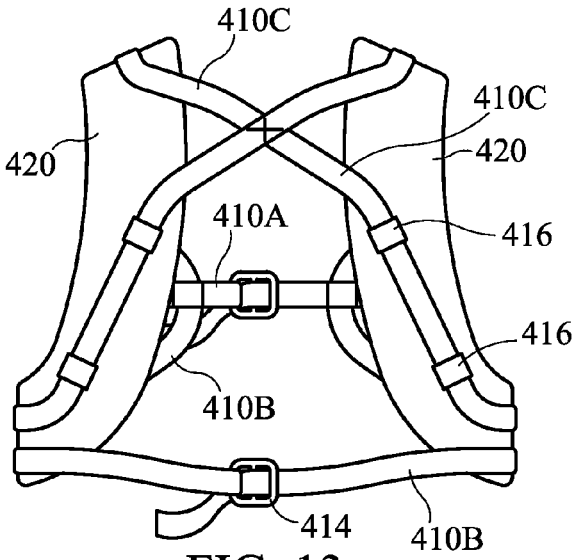
FIG. 13 is a rear view of the illumination gear of FIG. 13.
Figure 14:
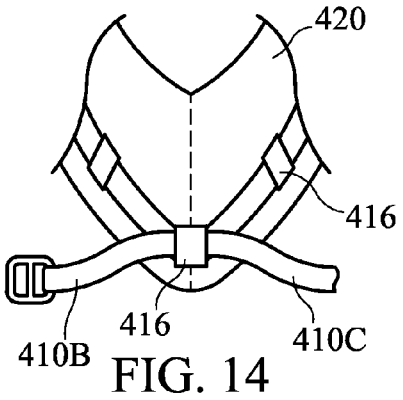
FIG. 14 is a view of the illumination gear of FIG. 13, showing the underarm area.

FIGS. 12-14 illustrate a fourth embodiment of illumination gear 400 according to the invention. In this embodiment, a shoulder harness 410 comprises shoulder pads 420 that are coupled to each other by straps 410A-410D. The shoulder pads 420 are padded and contoured to fit comfortably about a wearer's shoulder. A cross strap 410A is affixed to the front face of each shoulder pad 420, by stitching or by some other secure means A pair of first torso straps 410B are movably coupled with the cross strap 410A and extend downward and around the back of the torso of the wearer, to be fastened to each other with a releasable fastener 414. In this embodiment, each first torso strap 410B threads through a strap guide 416 in the first strap 410A. A pair of second torso straps 410C is affixed to the back of the shoulder harness 410. These second torso straps 410C cross across the back, as shown in FIG. 13, and extend around to the front of the torso of the wearer, to be fastened to each other with another releasable fastener 414. FIG. 14 is a partial view of the illumination gear 400, showing one of the first torso straps 410B and one of the second torso straps 410C being held in a strap guide 416. The strap guides 416 shown in FIGS. 12-14 are loops or open pockets that are stitched or otherwise affixed to the shoulder pads 420 or straps 410B and/or 410C and which serve to hold the torso straps 410B, 410C in the proper position. Multiple guides 416 may be provided on the shoulder pads 420 or straps 410B, 410C as needed. The torso straps 410B, 410C are easily adjustable to the specific torso size of the wearer by simply pulling the ends of the first torso straps 410B to a desired fit and securing the two ends with the releasable fastener 414 at the back of the torso and pulling the ends of the second torso straps 410C and securing the two ends with a releasable fastener 414 at the front of the torso.

The lamp 140 is mounted on one or both of the shoulder pads 420. The lamp 140 may be mounted directly onto the shoulder pad 420, as shown on the left side in FIG. 12, or a mounting strap 442 may be provided on the shoulder pad and fitted with the strap pad 130, as shown on the right side in FIG. 12. On the one hand, it is more economical to mount the lamp 140 directly onto the shoulder pad 420; on the other hand, it may be very desirable to provide the strap pad 130, depending on the intended application of the light harness 400, because of the additional higher/lower positionability of the lamp 140 on the torso.

Figure 15:
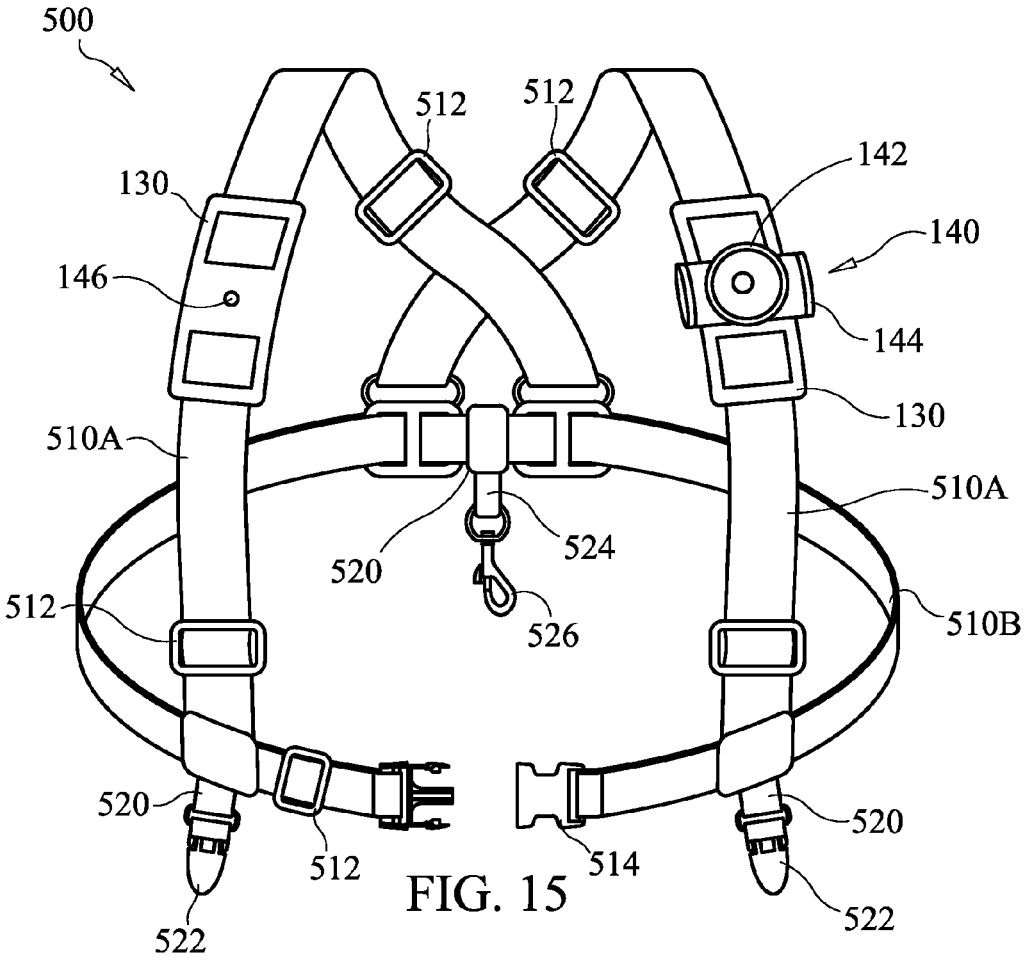
FIG. 15 is a fifth embodiment of the illumination gear according to the invention.

FIG. 15 is a front view of a fifth embodiment of illumination gear 500 according to the invention, which comprises a harness 510 and an illumination device 540 that is adjustably assembled on the harness 510. The harness 510 is constructed of a pair of main straps 510A and a cross-strap 510B. A closure device 514 is provided on the front portion of the cross strap 510B, which opens and closes and allows the user to put the harness 500 on by easily slipping the main straps 510A over the shoulders and fastening the cross strap 510B in the front. The main straps 510A fit over the torso of a user, similar to a pair of suspenders, and are anchored on the cross-strap 510B, as shown at 510C. Anchor devices 520 may be provided on the straps 510A and/or 510B to anchor the harness 510 to a waistband of trousers or other garment worn by the user. For example, ends of the front portion of the main straps 510A may be fitted with front anchor devices 522, such as snap clips that are attachable to the waistband of the trousers or other garment. These front anchor devices 522 may also be placed at any practical location on the cross strap 510B, in addition to or instead of on the main straps 510A. A back anchor device 524 may also be attached to the cross-strap 510B on the rear side of the harness 510. In the embodiment shown, a hook or snap or other attachment means 526 that is attachable to a belt loop on the pair of trousers or garment is attached to the back anchor means 524 and allows the user to anchor the back of the light harness 500 to the trousers or garment. The attachment means 526 can also be a strap loop with a hook or snap at its upper end. The strap loop is slipped over a belt, before the belt is threaded through belt and the snap or hook then coupled with the back anchor means 524. These anchor devices 522 and 524 serve to secure the harness 510 in place on the user. Strap adjustment means 512 may be provided on any or all straps, so as to make them adjustable in length.

Figure 16:
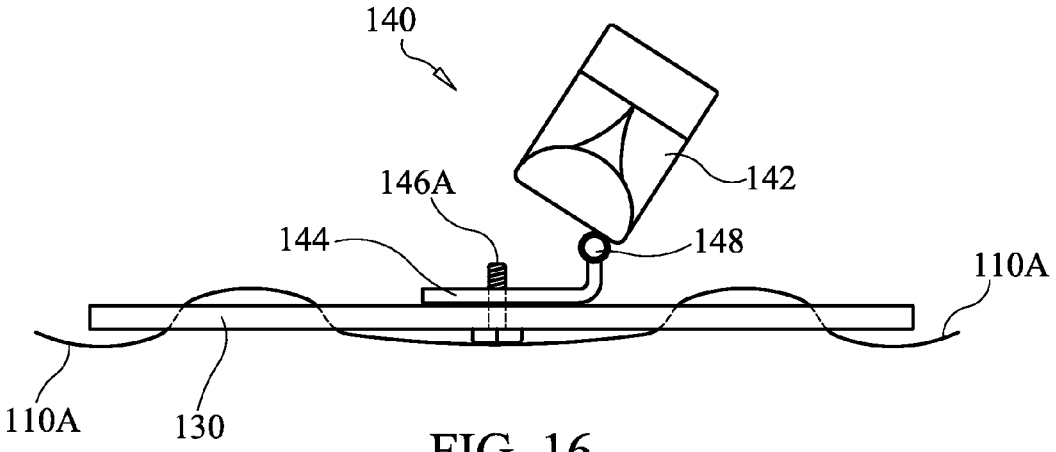
FIG. 16 is a side elevation view of the strap pad and the illumination device.

FIGS. 15 and 16 illustrate details of the lamp or illumination device 140, mounted on the strap pad 130. In all embodiments, a strap pad 130 serves as the mounting means for the lamp 140. A mounting aperture 146, shown in FIG. 15, is shown on one strap pad 130 and the lamp 140 shown mounted on the other one. The lamp 140 has a pivot axis 148 about which the body of the lamp 142 can rotate relative to the base 144.

Conventional strap material may be used to construct the straps of the various embodiments of the illumination gear 100-500 according to the invention. The straps may be elastic, in order to provide a snug, yet comfortable fit. Other suitable strap material may, of course, also be used, such as the webbing that is conventionally used on backpacks and other types of sporting or outdoor gear. The releasable fasteners used on the anchor straps are preferably conventional quick-release fasteners that are conventionally used for backpacks and other gear. The strap adjustment means are also means that are conventionally used for strap adjustment on backpacks, etc. It is understood, however, that the scope of the invention is not limited to the use of particular materials. Any suitable materials and devices may be used for the shoulder pads, harness straps, releasable fasteners, and adjustment means.

It is understood that the embodiments described herein are merely illustrative of the present invention. Variations in the construction of the illumination gear according to the invention may be contemplated by one skilled in the art without limiting the intended scope of the invention herein disclosed and as defined by the following claims.

What is claimed is:

1. Illumination gear comprising:

a strap-pad mounting strap that is worn by a person so as to extend over a top portion of the person's shoulder and at least partially down along a front portion of the person's torso;

a strap pad having a width greater and a length shorter than a width and a length of the strap-pad mounting strap and a greater stiffness than the strap-pad mounting strap, the strap pad having openings for threading the strap-pad mounting strap through the strap pad so as to slidably mount the strap pad on the strap-pad mounting strap; and an illumination device mounted on the strap pad;

wherein the strap pad has a flexibility that allows the strap pad to conform to contours on the person's torso and is slidably positionable along the strap-pad mounting strap, so as to position and hold the illumination device at a desired position along the strap-pad mounting strap, the illumination device thereby being selectively positionable at the top portion of the person's shoulder, the greater stiffness of the strap pad serving to securely hold the position of the strap pad at the desired position on the strap-pad mounting strap.

2. The illumination gear of claim 1, wherein the illumination device is a battery-operated lamp.

3. The illumination gear of claim 1, further comprising:

a vest, wherein the strap-pad mounting strap is provided on a front portion of the vest.

4. The illumination gear of claim 3, further comprising anchor straps for anchoring the vest to another garment, the anchor straps including a strap with a fastener means for fastening to the other garment.

5. The illumination gear of claim 1, further comprising:

a shoulder harness having two shoulder pads that are coupled to each other with straps, wherein the first illumination assembly is mounted on a front portion of one of the two shoulder pads.

6. The illumination gear of claim 1, further comprising a strap harness that fits over an upper torso of a person, with two front straps that extend downward, and wherein the first illumination assembly is mounted on one of the two front straps.

7. The illumination gear of claim 1, further comprising:

a pair of suspenders having two front straps, wherein the first illumination assembly is mounted on one of the two front straps.

8. The illumination gear of claim 1, wherein the strap-pad mounting strap includes a first strap-pad mounting strap and a second strap-pad mounting strap, the strap pad includes a first strap pad and a second strap pad, and the illumination device includes first illumination device and a second illumination device, and wherein a first illumination assembly includes the first illumination device mounted on the first strap pad that is mounted on the first strap-pad mounting strap, and a second illumination assembly includes the second illumination device mounted on the second strap pad that is mounted on the second strap-pad mounting strap.

* * * * *